US010916872B2

(12) United States Patent
Kojima et al.

(10) Patent No.: US 10,916,872 B2
(45) Date of Patent: Feb. 9, 2021

(54) PLATE-LIKE CONDUCTIVE MEMBER CONNECTION STRUCTURE AND PLATE-LIKE CONDUCTIVE PATH

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Hisashi Kojima, Mie (JP); Yasuo Omori, Mie (JP); Shunya Takeuchi, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 0 days.

(21) Appl. No.: 16/484,498

(22) PCT Filed: Jan. 22, 2018

(86) PCT No.: PCT/JP2018/001756
§ 371 (c)(1),
(2) Date: Aug. 8, 2019

(87) PCT Pub. No.: WO2018/147055
PCT Pub. Date: Aug. 16, 2018

(65) Prior Publication Data

US 2020/0006881 A1 Jan. 2, 2020

(30) Foreign Application Priority Data

Feb. 10, 2017 (JP) ..... 2017-022928

(51) Int. Cl.
*H01R 13/04* (2006.01)
*H01R 4/62* (2006.01)
(Continued)

(52) U.S. Cl.
CPC ..... *H01R 13/04* (2013.01); *H01R 4/62* (2013.01); *H01R 9/226* (2013.01); *H01R 11/01* (2013.01);
(Continued)

(58) Field of Classification Search
CPC ..... H01R 4/62; H01R 9/226; H01R 11/01; H01R 13/03; H01R 13/04; H01R 13/113; H01R 2201/26
(Continued)

(56) References Cited

U.S. PATENT DOCUMENTS 3,636,505 A * 1/1972 Poltonavage ..... H01R 31/02 439/787
5,588,884 A * 12/1996 Rudoy ..... H01R 13/187 439/787
(Continued)

FOREIGN PATENT DOCUMENTS

JP 7-022077 1/1995
JP 7-106001 4/1995
(Continued)

OTHER PUBLICATIONS

International Search Report dated Apr. 3, 2018.

*Primary Examiner* — Abdullah A Riyami
*Assistant Examiner* — Vladimir Imas
(74) *Attorney, Agent, or Firm* — Gerald E. Hespos; Michael J. Porco; Matthew T. Hespos

(57) ABSTRACT

It is aimed to provide a plate-like conductive member connection structure and a plate-like conductive path capable of reducing the number of connecting components. A plurality of plate-like conductive members (11) having conductivity and insulating members (13) configured to cover the plate-like conductive members (11) are provided, and the plurality of plate-like conductive members (11) are
(Continued)

connected to each other by terminal portions (12) respectively provided on the plate-like conductive members (11). According to this configuration, since the plate-like conductive members (11) can be connected without using a connecting component such as a wire, the number of connecting components can be reduced.

6 Claims, 19 Drawing Sheets

(51) Int. Cl.
*H01R 9/22* (2006.01)
*H01R 11/01* (2006.01)
*H01R 13/03* (2006.01)
*H01R 13/11* (2006.01)

(52) U.S. Cl.
CPC ..... *H01R 13/03* (2013.01); *H01R 13/113* (2013.01); *H01R 2201/26* (2013.01)

(58) Field of Classification Search
USPC ..... 439/884
See application file for complete search history.

(56) References Cited

U.S. PATENT DOCUMENTS 6,416,340 B2 * 7/2002 Schaefer ..... H01R 13/187 439/224
7,806,702 B2 * 10/2010 Aihara ..... H01R 12/7011 439/570
8,221,172 B2 * 7/2012 Ju ..... H01R 13/111 439/342
8,834,183 B2 * 9/2014 Komoto ..... H01R 12/71 439/507
9,548,552 B2 * 1/2017 Aboulkassem ..... H01R 12/721
9,859,630 B2 * 1/2018 MacNaughton ..... H01R 11/11
10,333,251 B2 * 6/2019 Miyamura ..... H01R 13/639
10,389,055 B1 * 8/2019 Lui ..... H01R 4/187
2004/0040732 A1 * 3/2004 Yuasa ..... H01R 13/17 174/68.2
2004/0040733 A1 * 3/2004 Yuasa ..... H01R 13/17 174/68.2
2004/0048524 A1 3/2004 Yuasa et al.
2007/0066152 A1 * 3/2007 Mohs ..... H01R 13/113 439/843
2007/0218736 A1 * 9/2007 Takizawa ..... H01R 11/01 439/247
2014/0342621 A1 * 11/2014 Omori ..... H01R 11/09 439/878
2017/0355327 A1 * 12/2017 Hida ..... B60R 16/0207

FOREIGN PATENT DOCUMENTS

JP 10-174254 6/1998
JP 2000-067943 3/2000
JP 2001-197632 7/2001
JP 2002-204518 7/2002
JP 2004-104946 2/2004
JP 2004-96950 3/2004
JP 2004-096976 3/2004
JP 2016-111825 6/2016
WO 2016/104101 6/2016

* cited by examiner

PLATE-LIKE CONDUCTIVE MEMBER CONNECTION STRUCTURE AND PLATE-LIKE CONDUCTIVE PATH

BACKGROUND

Field of the Invention

The invention relates to a plate-like conductive member connection structure and a plate-like conductive path.

Related Art

Japanese Unexamined Patent Publication No. 2016-111825 discloses a technique for disposing a plate-like or sheet-like conductive member along a wall surface of a vehicle and using the conductive member, for example, as a ground wiring member for connecting a battery and an electrical component. More particularly, the technique disclosed in Japanese Unexamined Patent Publication No. 2016-111825 configures a long conductive path by connecting a plurality of plate-like conductive members. The plate-like conductive members are disposed in a vehicle body and are connected by wires or the like.

The prior art has considered connecting the wires to the plate-like conductive members by soldering or the like, crimping terminal fittings to ends of the wires and accommodating and connecting the terminal fittings into a connector housing. However, such a connection structure requires many connecting components such as the wires, the terminal fittings and the connector housing.

The invention was completed on the basis of the above situation and aims to provide a plate-like conductive member connection structure and a plate-like conductive path capable of reducing the number of connecting components.

SUMMARY

A plate-like conductive member connection structure of the present invention is configured such that plate-like conductive members having conductivity are connected to each other by terminal portions respectively provided on the plate-like conductive members.

A plate-like conductive path of the invention includes plural plate-like conductive members having conductivity, insulating members configured to cover the plate-like conductive members, and the above-described plate-like conductive member connection structure.

The plate-like conductive members can be connected without using connecting components, such as wires. Thus, the invention enables the number of connecting components to be reduced.

The terminal portions may include a male terminal portion and a female terminal portion to be connected to each other.

The terminal portions may be connected via a connection terminal. According to this configuration, for example, the terminal portions to be connected to each other can have the same shape or three or more terminal portions can be connected.

The terminal portion may be constituted by a terminal constituting portion stamped out in such a manner as to be confined within a width of the plate-like conductive member in a developed state before machining. If the terminal constituting portion is not confined within the width of the plate-like conductive member, parts of a material before and after a part of the terminal constituting portion projecting out from the plate-like conductive members in a width direction are wasted. However, according to the invention, such a waste can be saved.

The terminal portion may include a resilient contact portion configured to resiliently contact a mating side. The plate-like conductive member may be made of a metal material, such as aluminum or aluminum alloy, and the resilient contact portion may be made of a metal material such as copper, copper alloy or stainless steel. According to this configuration, a sufficient contact pressure of the resilient contact portion with the mating side can be ensured. Thus, both the weight saving of the plate-like conductive members and the connection reliability of the terminal portions can be ensured.

Plural plate-like conductive members may be arranged at an interval in a plate thickness direction, and the insulating member may insulate between the plate-like conductive members.

DETAILED DESCRIPTION

A first embodiment of the invention is described with reference to FIGS. 1 to 9.

A plate-like conductive path 10 in this embodiment is used mainly for wiring inside an automotive vehicle. The plate-like conductive path 10 is formed by connecting plural plate-like conductive members 11 having conductivity to each other by terminals 12 respectively provided on the plate-like conductive members 11. The plate-like conductive path 10 can be used as a conductive path for power for transmitting a relatively large current such as power for operation or as a grounding conductive path for electrically connecting electrical components and a battery. When using the plate-like conductive path 10 as a grounding conductive path, the plate-like conductive path 10 is disposed along a vehicle interior side of a wall surface of a vehicle body. The plate-like conductive path 10 is a strip-like conductive path long in one direction and can be a main line having branches. A length and other dimensions of the plate-like conductive path 10 are set at appropriate dimensions to extend along a wiring path of the vehicle.

Figure 1:
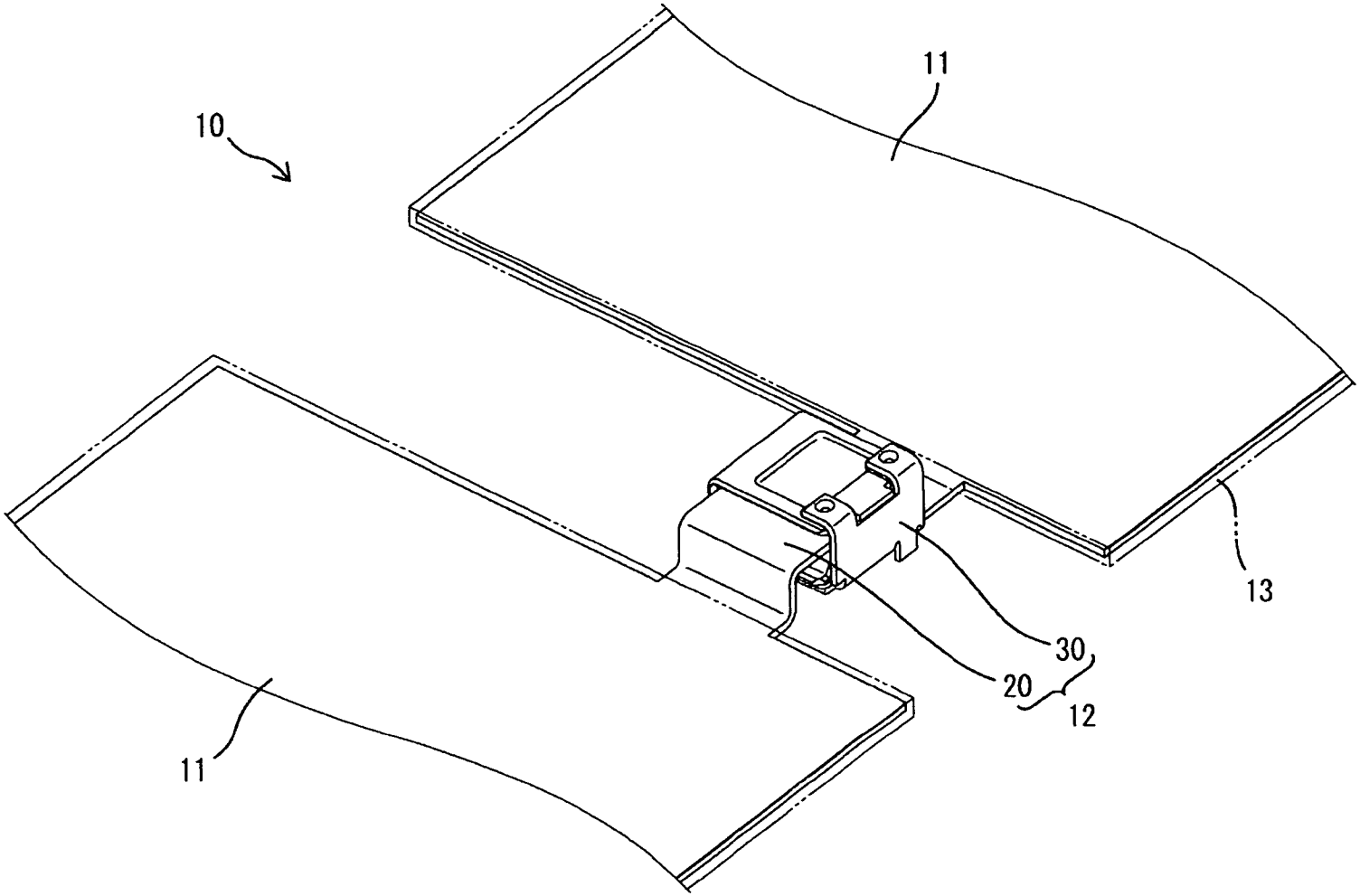
FIG. 1 is a perspective view showing a plate-like conductive member connection structure in a first embodiment in a state where terminal portions are connected.

In the following description, in each constituent member, a front side (an oblique right-upper side in the plate-like conductive member 11 on a left-lower side of FIG. 1, an oblique left-lower side in the plate-like conductive member 11 on a right-upper side) with respect to a connecting direction to the other plate-like conductive member 11 is referred to as a front, and an opposite side is referred to as a rear. Further, upper and lower sides of FIG. 1 are referred to as top and back sides.

The plate-like conductive member 11 is a flat thin plate made of metal (aluminum or aluminum alloy) and forms a strip having a predetermined width. The plate-like conductive member 11 can exhibit a good heat radiating property by having a wide area.

The plate-like conductive member 11 is covered with an insulating member 13 to be insulated and protected. The insulating member 13 is desirably flexible, and may be a resin sheet (PVC sheet or the like) or a shrinkable tube.

The terminal 12 is integral to the plate-like conductive member 11 and is at a position closer to an end than a widthwise center of the plate-like conductive member 11. In this embodiment, the terminal 12 of one plate-like conductive member 11 is closer to a right end than the widthwise center and the terminal 12 of the other plate-like conductive member 11 is closer to a left end than the widthwise center. In this way, the plate-like conductive members 11 are disposed linearly without deviating in a width direction with the terminal 12 of the one plate-like conductive member 11 and the terminal 12 of the other plate-like conductive member 11 connected.

Figure 5:
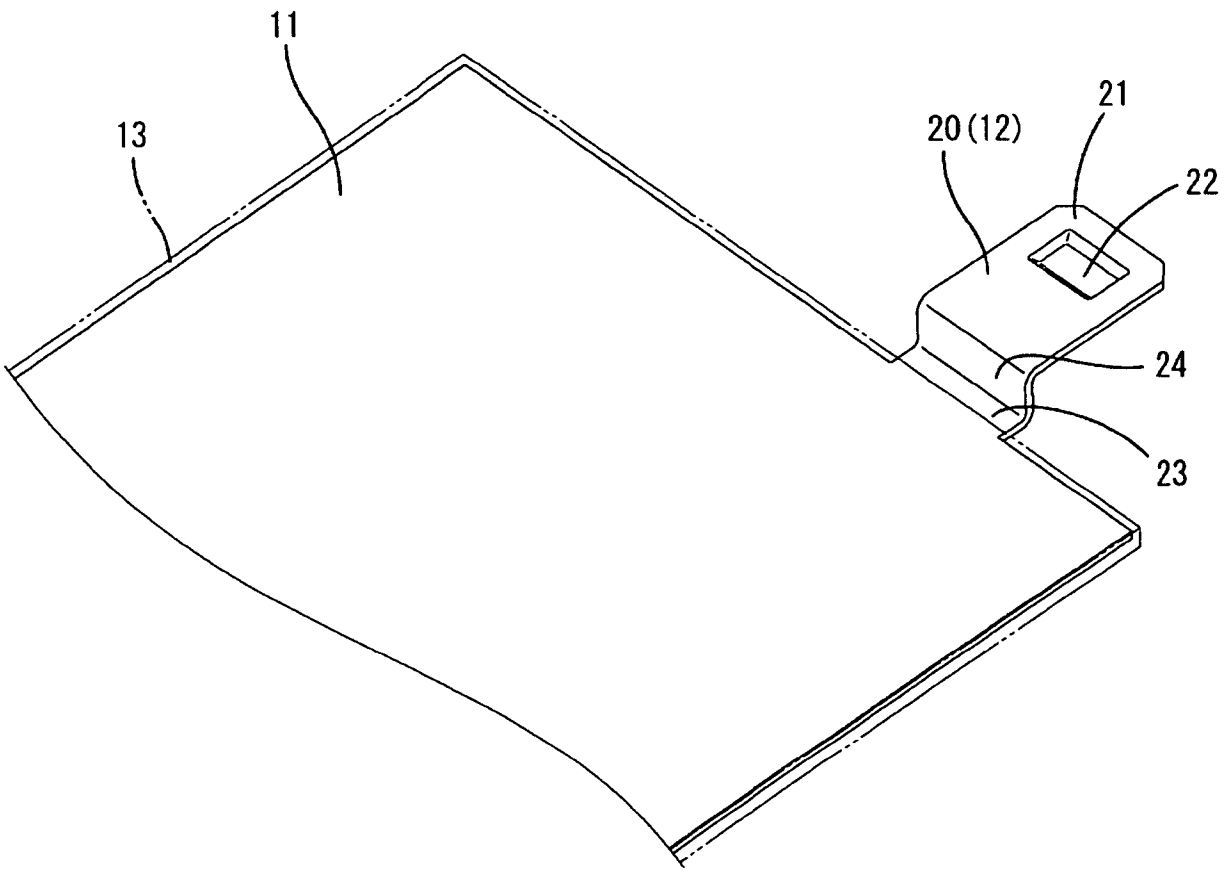
FIG. 5 is a perspective view showing one plate-like conductive member.

The terminals 12 include a male terminal 20 and a female terminal 30 to be connected to each other. The male terminal 20 includes a projecting piece 21 projecting forward, as shown in FIG. 5. The projecting piece 21 is substantially parallel to plate surfaces of the plate-like conductive member 11. Both left and right corner parts on the front end of the projecting piece 21 are cut off obliquely.

Figure 4:
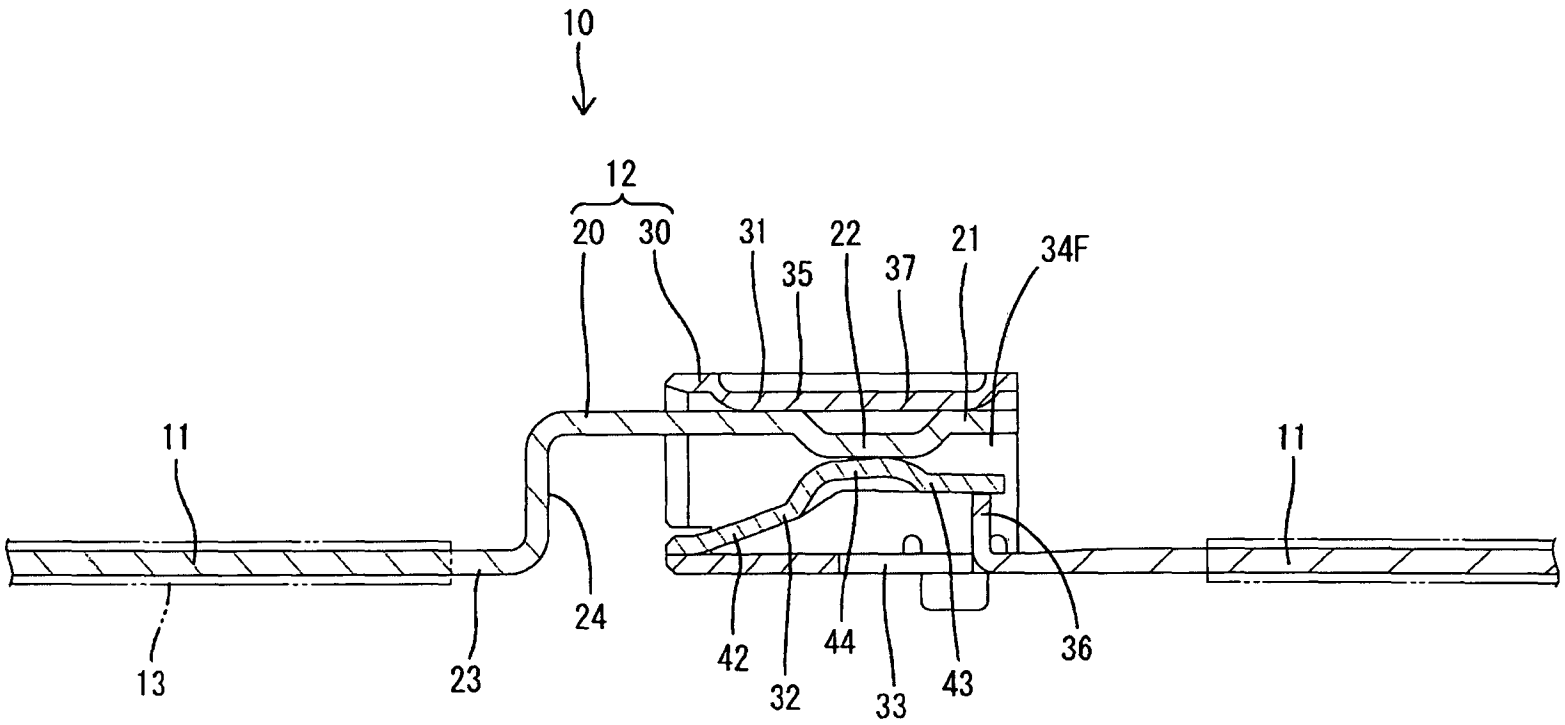
FIG. 4 is a section along A-A of FIG. 2 showing the plate-like conductive member connection structure in the state where the terminal portions are connected.

As shown in FIG. 4, the projecting piece 21 is inserted into a box 31 of the female terminal 30 and is pressed by a resilient contact 32 of the female terminal portion 30. The projecting piece 21 is provided with a pressing portion 22 to be pressed by the resilient contact 32 of the female terminal 30. The pressing portion 22 projects toward a back surface of the projecting piece 21 and has a projecting dimension substantially equal to a plate thickness of the projecting piece 21. The pressing portion 22 has a wide rectangular shape in a plan view, and is closer to a front end than a center of the projecting piece 21 in a front-rear direction. Note that a top surface side of the pressing portion 22 is recessed.

As shown in FIG. 5, the male terminal 20 has a step-like bent shape so that the projecting piece 21 is displaced slightly toward a top side of the plate-like conductive member 11.

Figure 6:
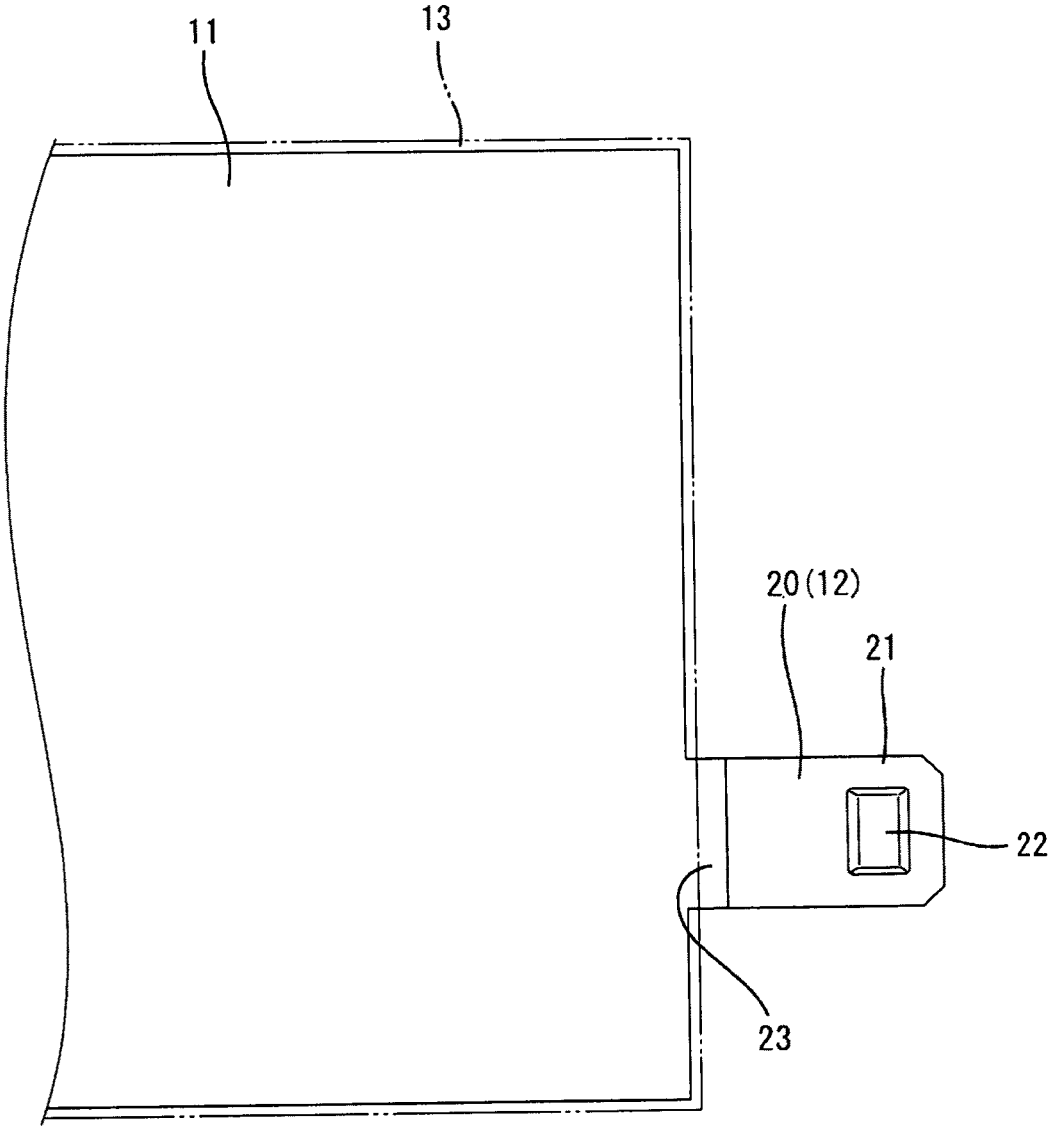
FIG. 6 is a plan view showing the one plate-like conductive member.

The male terminal 20 includes a base 23 projecting forward on the same plate surface as the plate-like conductive member 11 from an end edge of the plate-like conductive member 11 and an intermediate portion 24 rising toward the top side from the front end edge of the base 23, and the projecting piece 21 projects forward from the top end edge of the intermediate portion 24. The intermediate portion 24 is substantially at a right angle to the base 23. As shown in FIG. 6, the male terminal 20 has a substantially constant width entirely (base 23, intermediate portion 24 and projecting piece 21).

The male terminal 20 is constituted by a terminal constituting portion (not shown) integrally stamped out with the plate-like conductive member 11 on an end part of the plate-like conductive member 11. The terminal constituting portion of the male terminal 20 is confined within the width of the plate-like conductive member 11.

The female terminal 30 includes the box 31 into which the projecting piece 21 of the male terminal 20 is inserted, and the resilient contact 32 that resiliently contacts the projecting piece (mating side) 21 inserted into the box 31.

The box 31 is a wide flat rectangular tube that is open in the front-rear direction. The box 31 includes a bottom wall 33, two side walls 34F, 34S rising on both left and right sides of the bottom wall 33 and a ceiling 35 arranged to face the bottom wall 33.

As shown in FIG. 4, the bottom wall 33 is connected to the plate-like conductive member 11 without any step and has an excessive deflection preventing portion 36 for preventing excessive deflection of the resilient contact 32. The side walls 34F, 34S are substantially at a right angle to the bottom wall 33 (see FIG. 8). The ceiling 35 is provided with a bulge 37 slightly (by a dimension substantially equal to the plate thickness) bulging inward of the box 31. An outer side (top side) of the bulge 37 is recessed.

Figure 2:
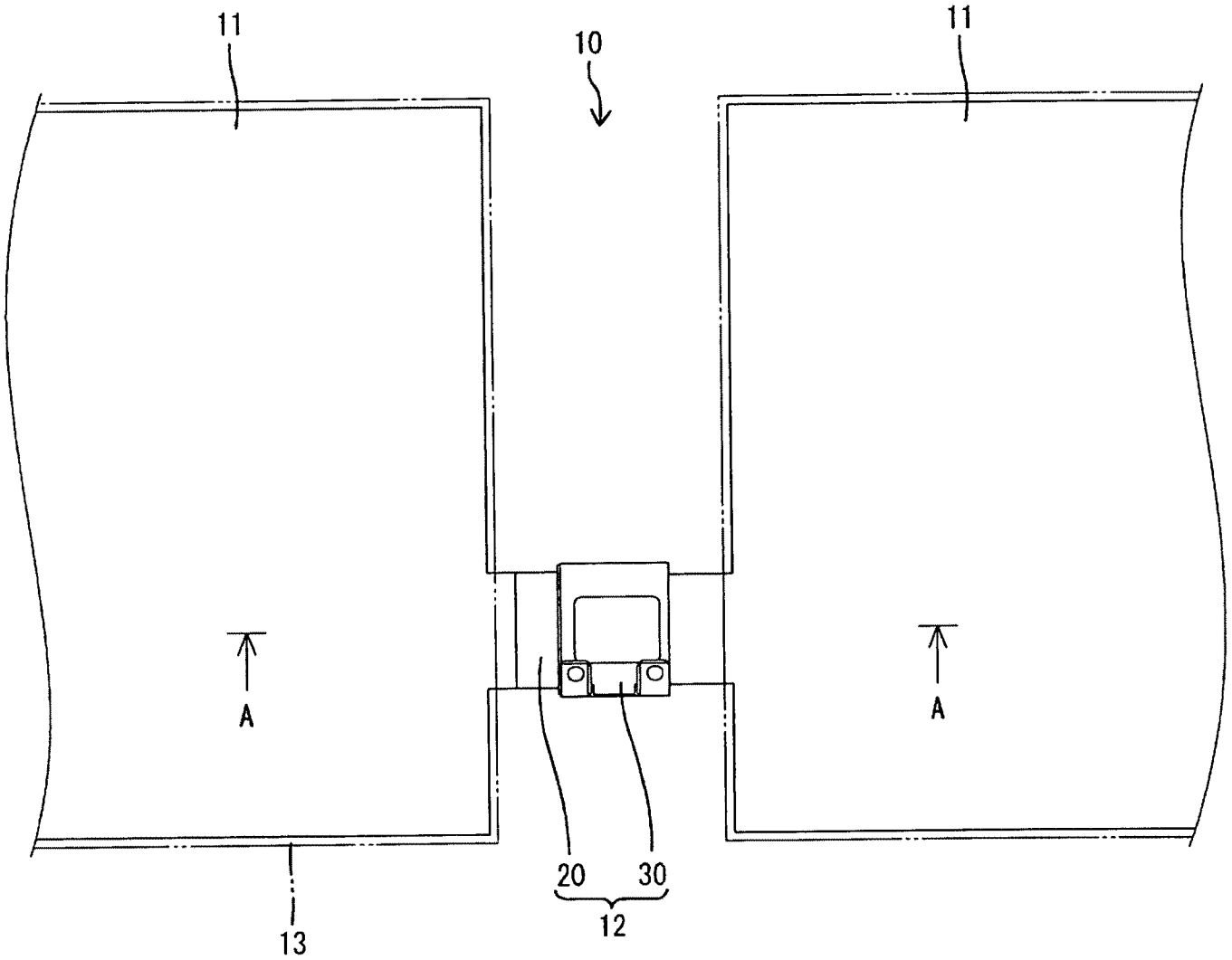
FIG. 2 is a plan view showing the plate-like conductive member connection structure in the state where the terminal portions are connected.
Figure 3:
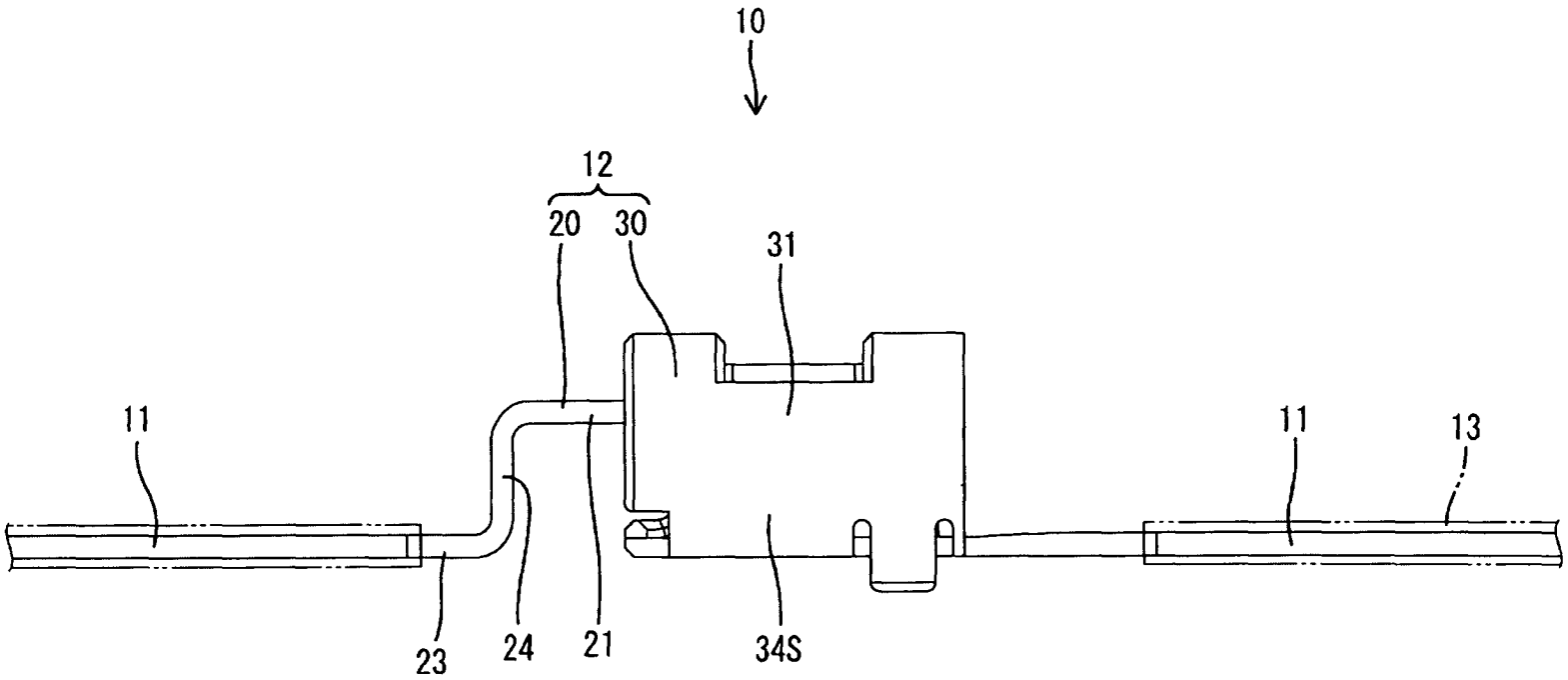
FIG. 3 is a side view showing the plate-like conductive member connection structure in the state where the terminal portions are connected.

The bulge 37 is formed in most of the ceiling 35. An area of the bulge 37 is larger than that of the pressing portion 22 of the male terminal 20, as shown in FIG. 4. As shown in FIG. 2, the bulge 37 has a rectangular shape long in the front-rear direction in a plan view.

Figure 7:
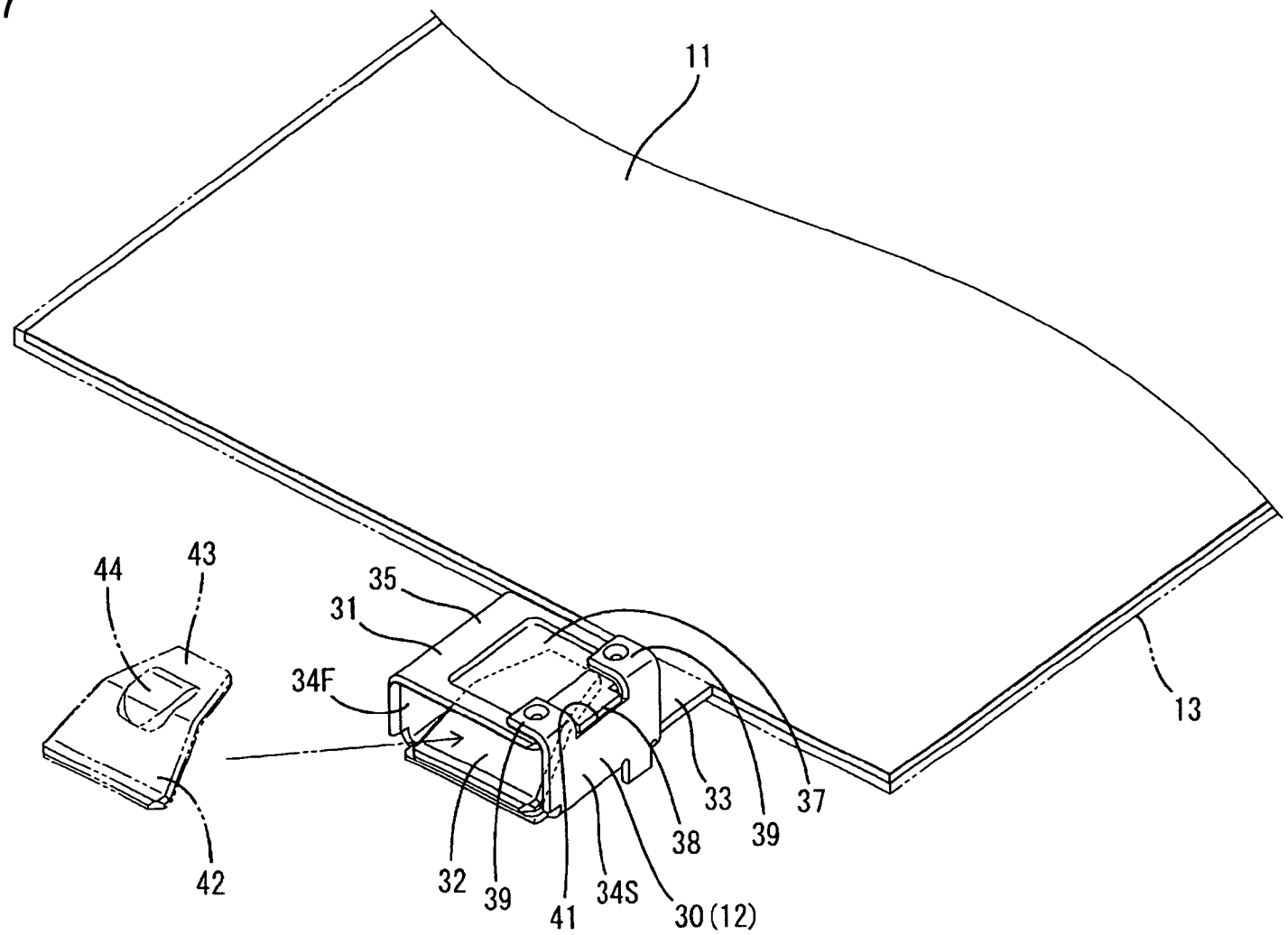
FIG. 7 is a perspective view showing the other plate-like conductive member.
Figure 8:
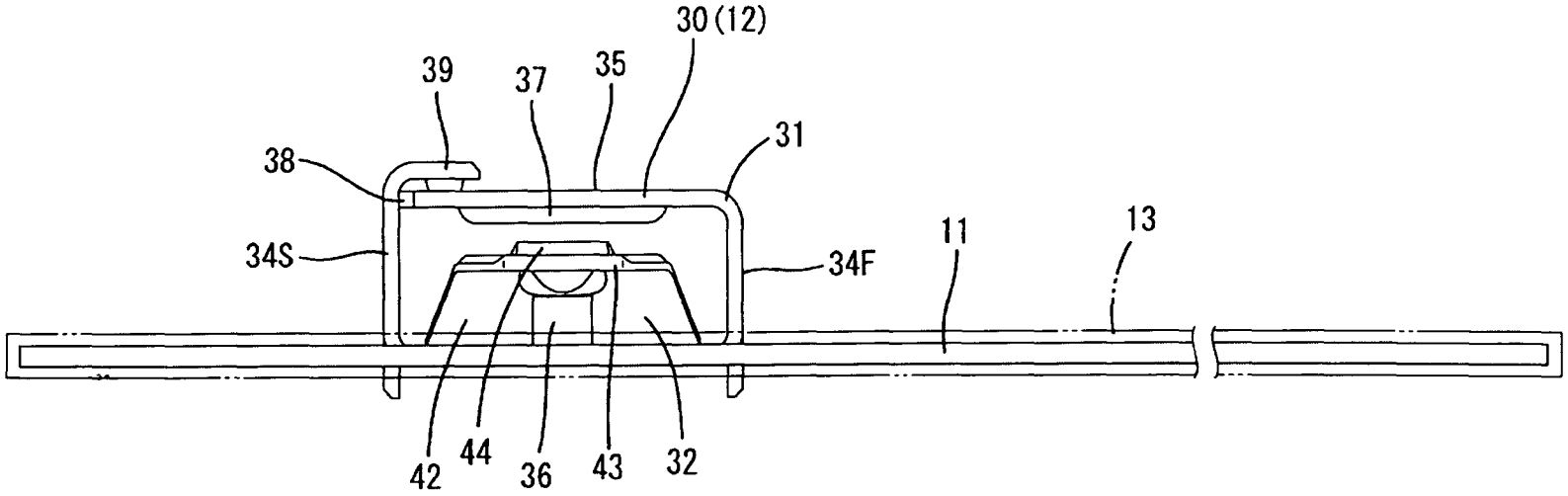
FIG. 8 is a back view showing the other plate-like conductive member.

The ceiling 35 is bent at an end edge of the first side 34F to be substantially parallel to the bottom wall 33, and the tip thereof is locked to an end edge of the second side wall 34S (see FIG. 7).

A locking portion 38 to be locked to the end edge of the second side wall 34S projects on the tip edge of the ceiling portion 35. The locking portion 38 is located in a central part of the ceiling 35 in the front-rear direction and contacts the end edge of the second side portion 34S from the top side to prevent the ceiling 35 from being displaced inward of the box 31.

Hooks 39 are provided on the end edge of the second side wall 34S and are bent toward the ceiling 35 for hooking to the top of the ceiling 35 (see FIG. 7). Two of the hooks 39 are provided on front and rear sides of the second side wall 34S. A part between the pair of hooks 39 serves as a receiving portion 41 with which the locking portion 38 of the ceiling portion 35 comes into contact.

Figure 9:
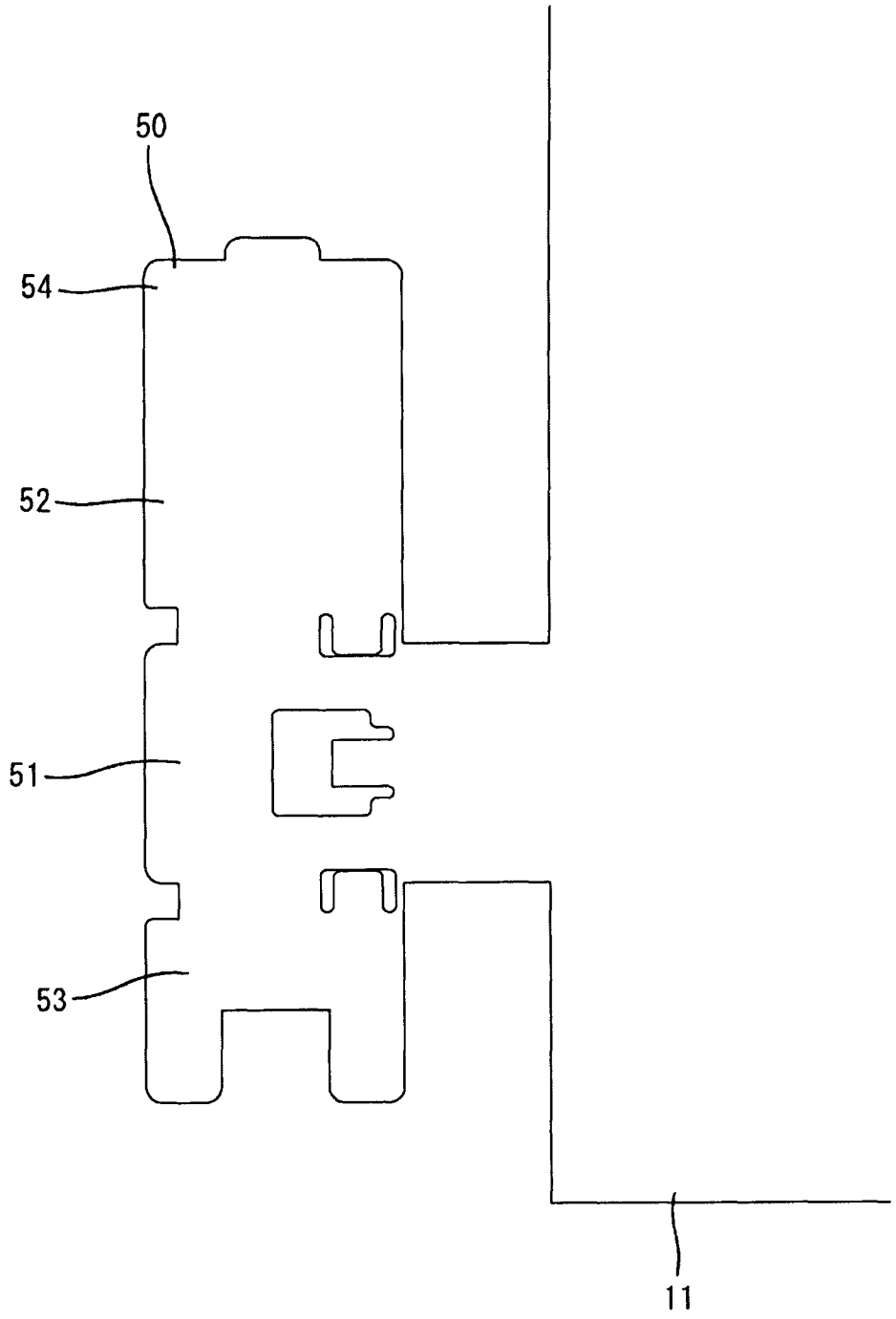
FIG. 9 is a development showing a developed state of the terminal portion.

The box portion 31 is constituted by a terminal constituting portion 50 integrally stamped out with the plate-like conductive member 11 on an end part of the plate-like conductive member 11. As shown in FIG. 9, the terminal constituting portion 50 has a rectangular shape extending along an end edge of the plate-like conductive member 11 and confined within the width of the plate-like conductive member 11 in a developed state before machining.

A bottom constituting portion 51 of the terminal constituting portion 50 constituting the bottom wall 33 projects forward from the end of the plate-like conductive member 11. A first side constituting portion 52 of the first side wall 34F and a second side constituting portion 53 of the second side 34S are connected to both left and right sides of the bottom constituting portion 51. The first side constituting portion 52 and a ceiling portion constituting portion 54 of the ceiling 35 are disposed on a central side in the width direction of the plate-like conductive member 11, and the second side constituting portion 53 is disposed on a side in the width direction of the plate-like conductive member 11.

The resilient contact portion 32 is made of a metal material (copper, copper alloy, stainless steel or the like) different in type from the box portion 31. As shown in FIG. 7, the resilient contact portion 32 is produced separately from the box 31 and integrated with the box 31 by appropriate fixing means, such as crimping or fitting.

As shown in FIG. 4, the resilient contact portion 32 includes a leg 42 rising from the bottom wall 33 in a state integrated with the box 31, and a contact 43 configured to contact the projecting piece 21 of the male terminal portion 20. The leg 42 is inclined with respect to the bottom wall 33, and the contact 43 is substantially parallel to the ceiling 35. A projecting portion 44 projecting toward the ceiling 35 is provided on a side of the contact 43 facing the ceiling portion 35.

The resilient contact 32 is cantilevered rearward from a front end of the box 31 and has a free rear end. The free end of the resilient contact 32 is located on the top side of the excessive deflection preventing portion 36. As shown in FIG. 7, a width of the resilient contact portion 32 is larger on the base end and smaller on the free end. The width of the resilient contact portion 32 is reduced gradually toward the free end.

Subsequently, an example of a connecting operation of the plate-like conductive members 11 in this embodiment is described.

The terminal portions 12 of the one and other plate-like conductive members 11 are caused to face each other and connected. The projecting piece 21 of the male terminal portion 20 is inserted into the box 31, contacts the leg 42 of the resilient contact portion 32 and is guided toward the ceiling 35 by the inclination of the leg 42. The projecting piece 21 of the male terminal 20 enters between the resilient contact 32 and the ceiling 35. The resilient contact 32 is pressed toward the bottom wall 33 to be displaced resiliently. The projecting piece 21 of the male terminal 20 is pressed against the ceiling 35 by a resilient restoring force of the resilient contact 32. In this way, the terminals 12 are connected and the connecting operation of the plate-like conductive members 11 is completed. The positions of the connected plate-like conductive members 11 in a height direction (positions in the plate thickness direction) are aligned, the terminals 12 are connected on the top surface sides of the plate-like conductive members 11 and the back surfaces of the plate-like conductive members 11 are flat. Further, the positions of the connected plate-like conductive members 11 in the width direction are aligned, and left and right side edges are disposed along the same straight lines.

Next, functions and effects of the embodiment thus configured are described.

The connection structure of the plate-like conductive members 11 of this embodiment is for connecting the plate-like conductive members 11 having conductivity to each other by the terminals 12 respectively provided on the plate-like conductive members 11. According to this configuration, since the plate-like conductive members 11 can be connected without using a connecting component such as a wire, the number of connecting components can be reduced. Further, an operation of connecting many connecting components, such as wires can be omitted. Thus, manhours can be reduced.

Further, the terminal 12 is constituted by the terminal constituting portion 50 stamped out in such a manner as to be confined within the width of the plate-like conductive member 11 in the developed state before machining. If the terminal constituting portion is not confined within the width of the plate-like conductive member, parts of a material before and after a part of the terminal constituting portion projecting out from the plate-like conductive member in the width direction (parts extending along the side edges of the plate-like conductive members) are wasted. However, according to the configuration of this embodiment, such a waste can be saved.

Further, the female terminal portion 30 includes the resilient contact portion 32 configured to resiliently contact the mating side, the plate-like conductive members 11 are made of the metal material such as aluminum or aluminum alloy, and the resilient contact portion 32 is made of the metal material such as copper, copper alloy or stainless steel. Here, if a resilient contact portion is made of aluminum or aluminum alloy, a force (resilient force) of the resilient contact portion for pressing a projecting piece portion against a ceiling may be insufficient. However, since the resilient contact portion 32 is made of the metal material such as copper, copper alloy or stainless steel, a sufficient contact pressure with the mating side can be ensured. Thus, both the weight saving of the plate-like conductive members 11 and the connection reliability of the terminals 12 can be ensured.

Second Embodiment

Figure 10:
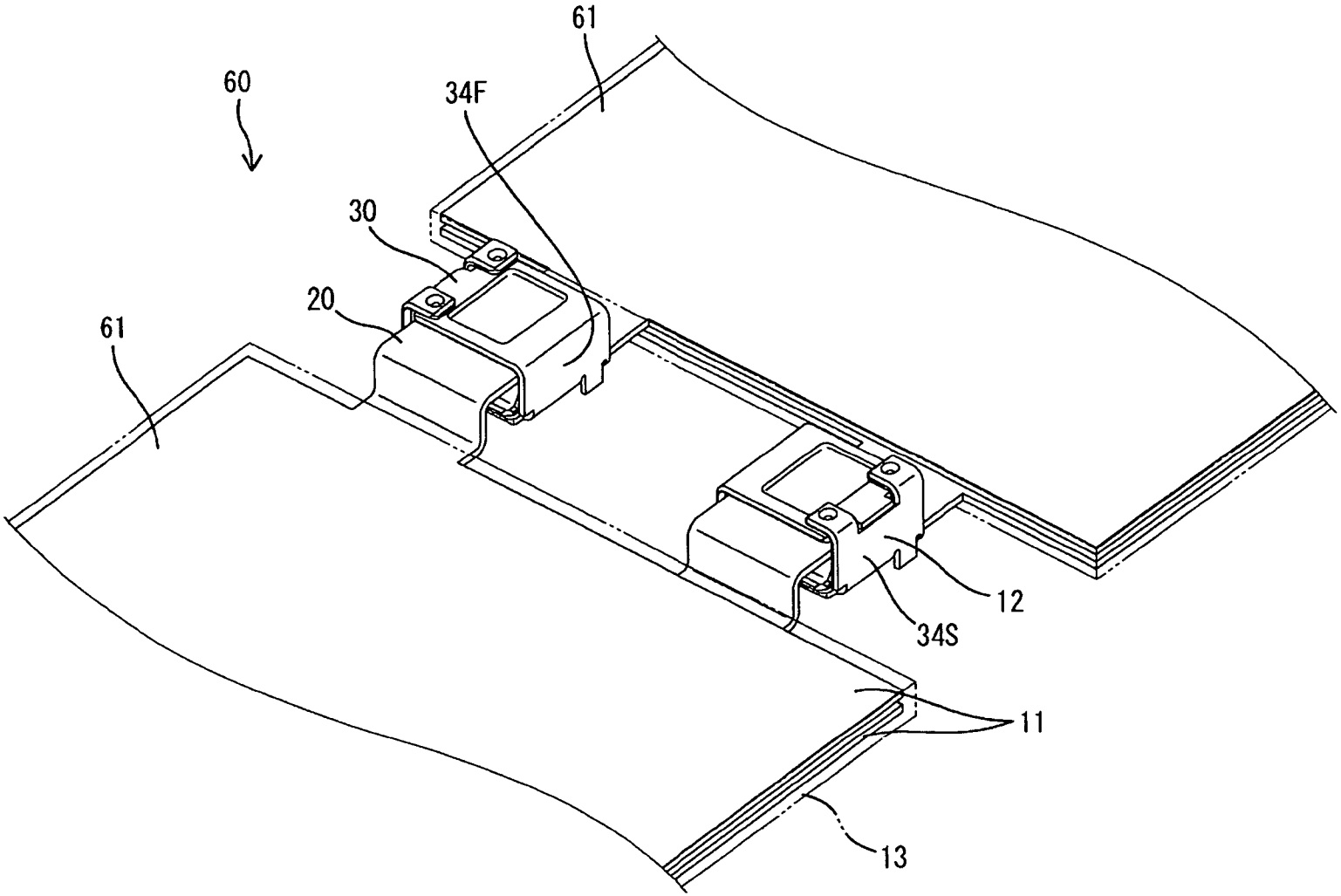
FIG. 10 is a perspective view showing a plate-like conductive member connection structure in a second embodiment in a state where terminal portions are connected.
Figure 11:
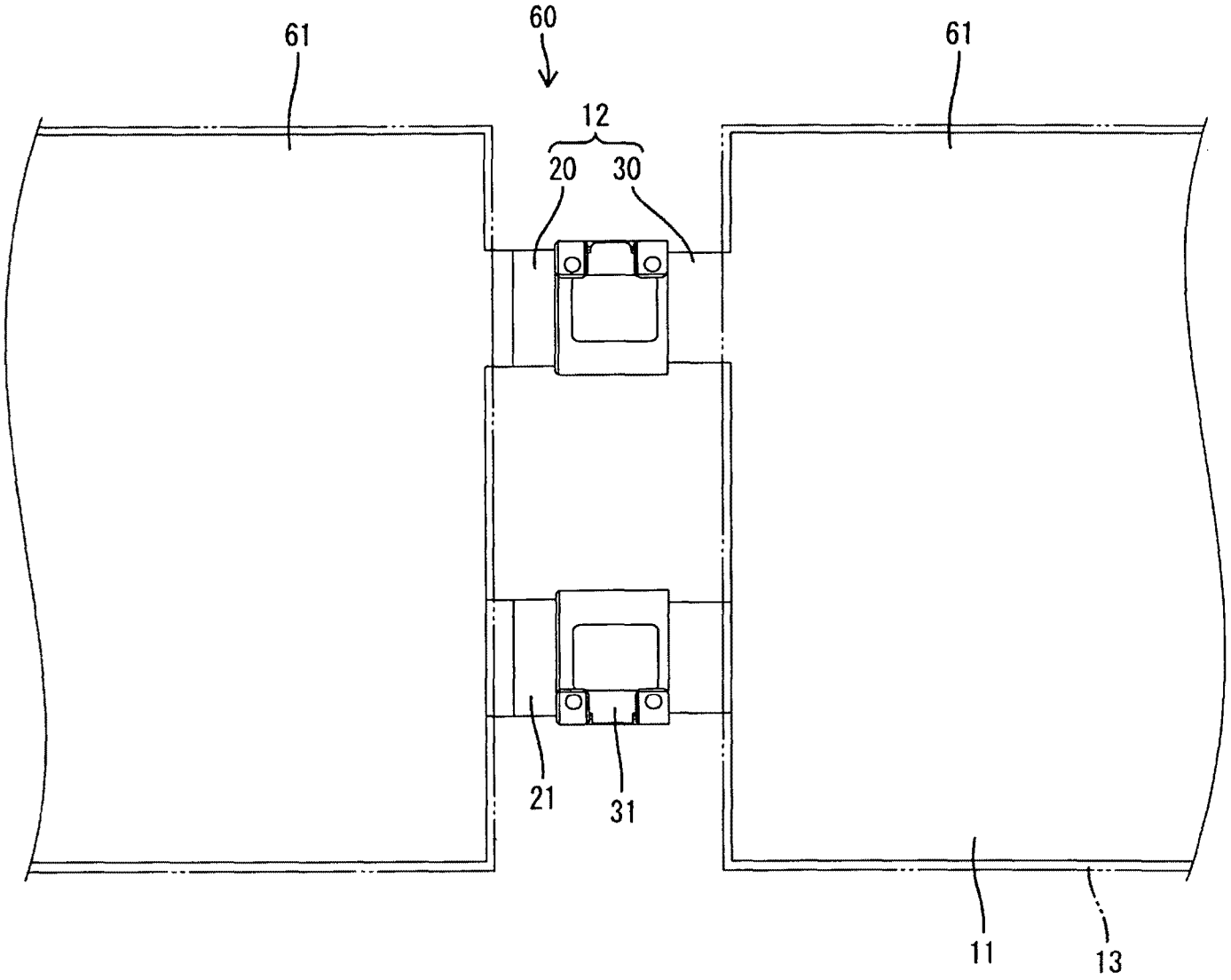
FIG. 11 is a plan view showing the plate-like conductive member connection structure in the state where the terminal portions are connected.
Figure 12:
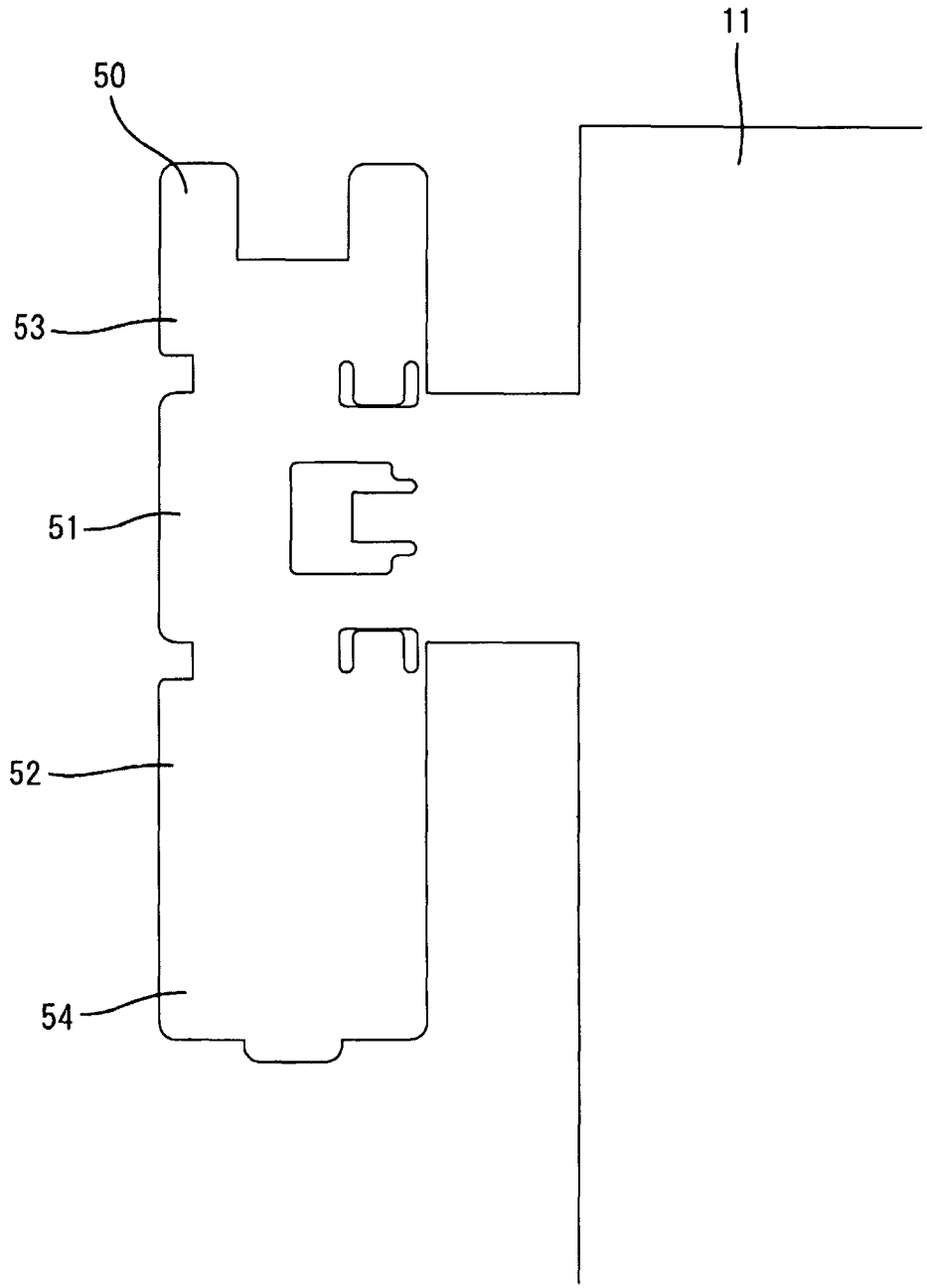
FIG. 12 is a development showing a developed state of the terminal portion.
Figure 13:
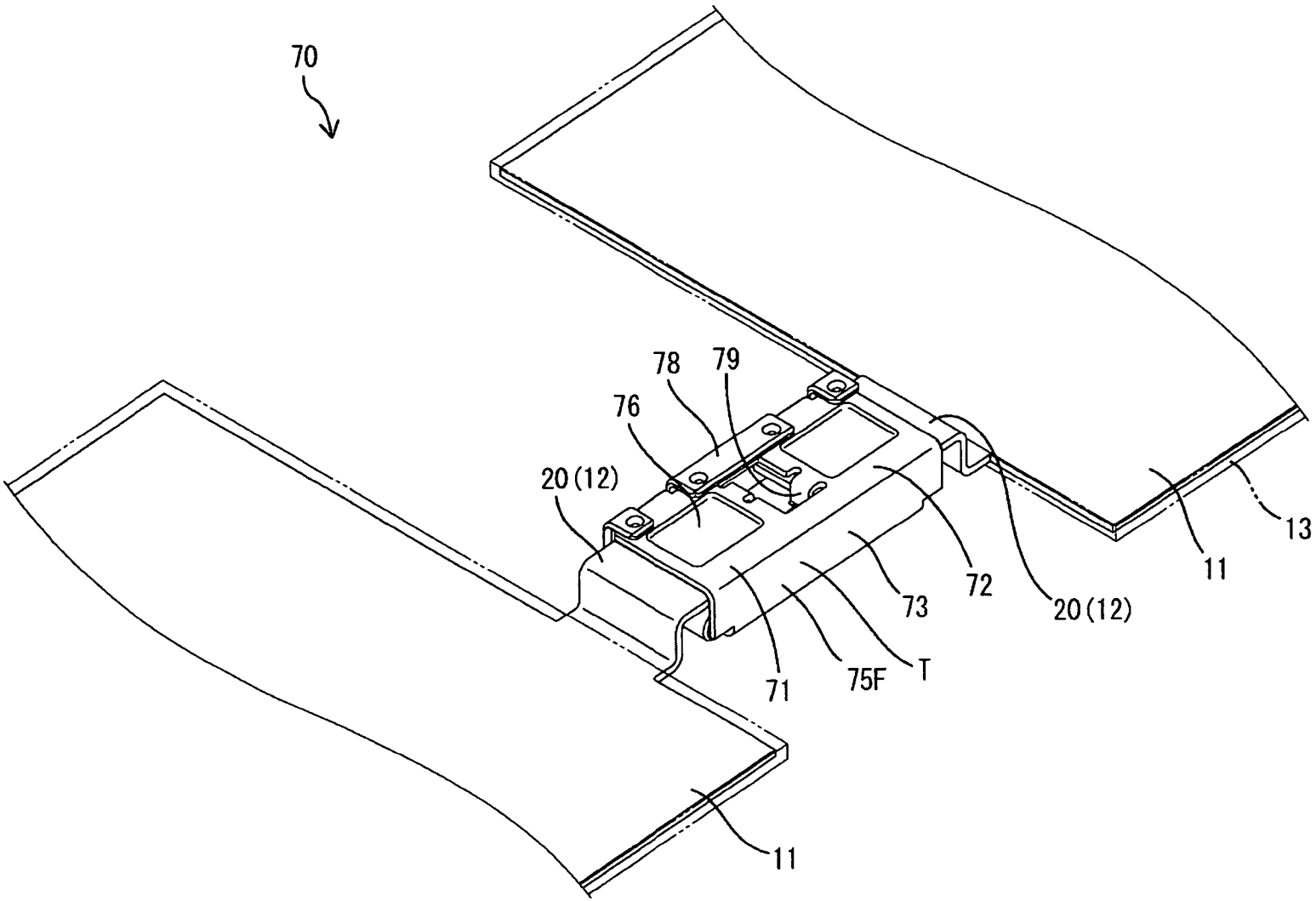
FIG. 13 is a perspective view showing a plate-like conductive member connection structure in a third embodiment in a state where terminal portions are connected.
Figure 14:
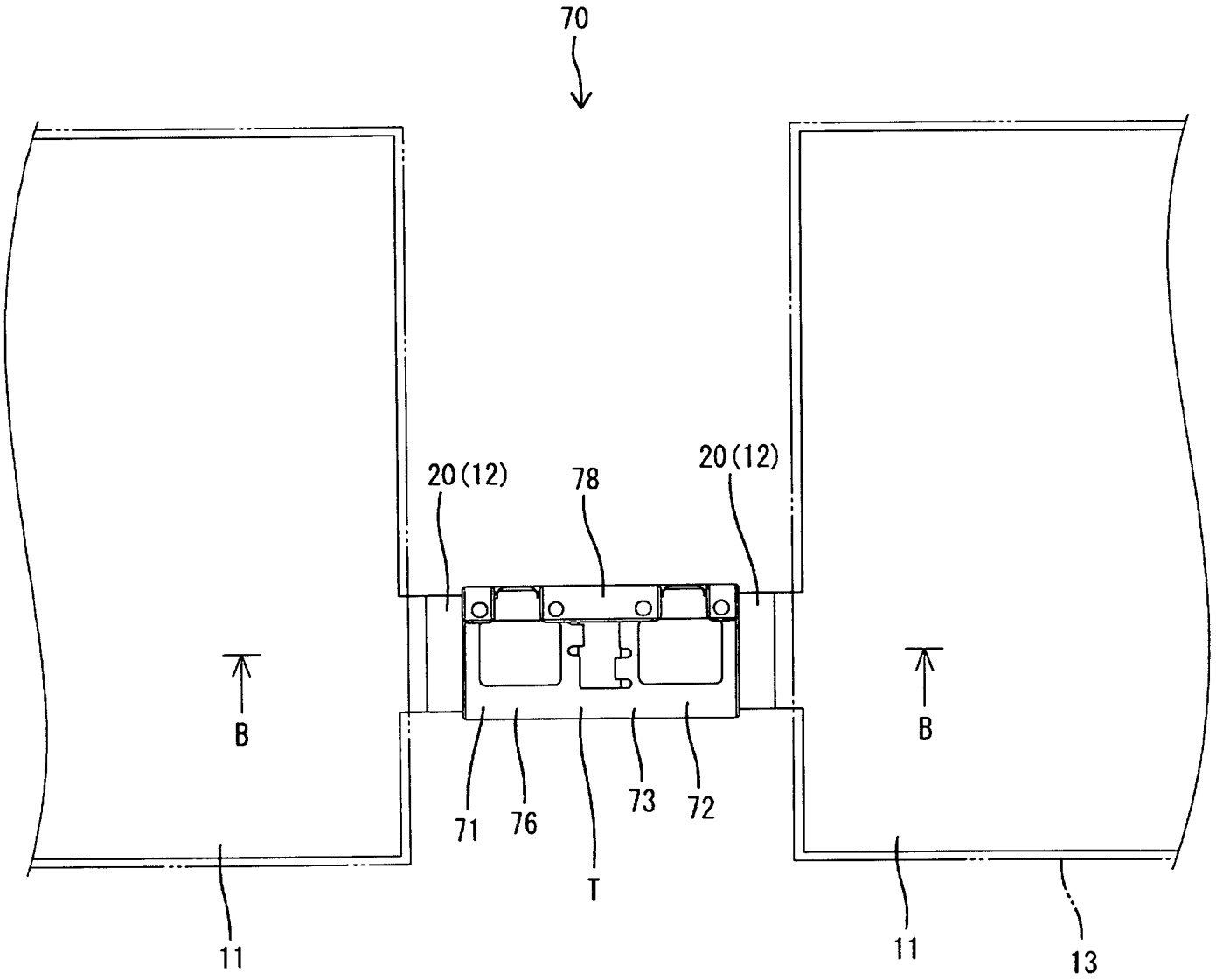
FIG. 14 is a plan view showing the plate-like conductive member connection structure in the state where the terminal portions are connected.

Next, a plate-like conductive path 60 according to a second embodiment of the invention is described with reference to FIGS. 10 to 12.

The plate-like conductive path 60 of this embodiment differs from the first embodiment in that plate-like conductive members 11 are arranged at an interval in a plate thickness direction. Note that the same components as in the first embodiment are denoted by the same reference signs and repeated description is omitted.

The plate-like conductive path 60 according to this embodiment is such that the plate-like conductive members 11 are arranged at an interval in the plate thickness direction. The two plate-like conductive members 11 are overlapped while being insulated by an insulating member 13, and entirely covered and protected by the insulating member 13.

The plate-like conductive members 11 are made of a metal material such as aluminum or aluminum alloy as in the first embodiment. The plate-like conductive members 11 overlapped on top and back sides have equal width and length.

Conductive members 61 each including the two plate-like conductive members 11 overlapped on the top and back sides and the insulating member 13 are connected to each other by terminals 12 as in the first embodiment. The terminals 12 are displaced from each other in a width direction in the plurality of plate-like conductive members 11 provided in the conductive member 61. In this embodiment, the terminal 12 of one plate-like conductive member 11 is provided on one side in the width direction, and the terminal 12 of the other conductive member 11 is provided on the other side in the width direction.

The terminals 12 include male terminals 20 and female terminals 30 to be connected to each other as in the first embodiment. In this embodiment, the male terminals 20 are provided on one conductive member 61 and the female terminals 30 are provided on the other conductive member 61. The male terminals 20 and the female terminals 30 are configured similarly to those of the first embodiment.

The male terminals 20 are disposed at positions symmetrical with respect to the width direction in the conductive member 61. Height positions of projecting pieces 21 of the male terminal 20 on the top side of the conductive member 61 and the male terminal portion 20 on the back side are displaced by as much as a displacement between height positions of the plate-like conductive members 11.

The female terminals 30 are shaped symmetrically with respect to the width direction in the conductive member 61. In particular, two of the female terminal portions 30 of the conductive member 61 are both such that a first side 34F is disposed on a widthwise central side and a second side 34S is disposed on a widthwise outer side.

As in the first embodiment, the female terminal 30 is constituted by a terminal constituting 50 stamped out in such a manner as to be confined within a width of the plate-like conductive member 11 in a developed state before machining. The terminal constituting portions 50 of the female terminals 30 of the conductive member 61 are shaped symmetrically. As shown in FIGS. 9 and 12, the terminal constituting portions 50 are such that a first side constituting portion 52 and a ceiling constituting portion 54 are arranged on a widthwise central side and a second side portion constituting portion 53 is disposed on a widthwise side.

The plate-like conductive path 60 in this embodiment is connected by causing the terminals 12 of one conductive member 61 and the terminals 12 of the other conductive members 61 to face each other and connecting the terminals 12. The terminals 12 of the plate-like conductive members 11 on the top sides of the conductive members 61 are connected to each other and the terminals 12 of the plate-like conductive members 11 on the back sides are connected to each other. With the conductive members 61 connected, height positions (positions in the plate thickness direction) of the plate-like conductive members 11 on the top sides are aligned and height positions of the plate-like conductive members 11 on the back sides are aligned.

As described above, in this embodiment, the conductive members 11 are connected to each other by the terminals 12 respectively provided on the plate-like conductive members 11 as in the first embodiment. Therefore, the plate-like conductive members 11 can be connected without using a connecting component such as a wire and the number of connecting components can be reduced.

Third Embodiment

Next, a plate-like conductive path 70 according to a third embodiment of the invention is described with reference to FIGS. 13 to 19.

The plate-like conductive path 70 of this embodiment differs from the first embodiment in that terminals 12 are connected via a connection terminal T. Note that the same components as in the first embodiment are denoted by the same reference signs and repeated description is omitted.

The plate-like conductive path 70 of this embodiment is such that plate-like conductive members 11 are connected to each other by the terminals 12 respectively provided on the plate-like conductive members 11, as in the first embodiment. The plate-like conductive members 11 are made of a metal material such as aluminum or aluminum alloy as in the first embodiment. The terminals 12 of the plate-like conductive members 11 to be connected to each other are both male terminals 20. The structure of the male terminal portions 20 is similar to that of the first embodiment.

The connection terminal T includes a first connecting portion 71 to be connected to one of the terminals 12 to be connected to each other and a second connecting portion 72 to be connected to the other terminal 12. The connection terminal T is a relay terminal for relaying between the one terminal 12 and the other terminal 12.

Figure 17:
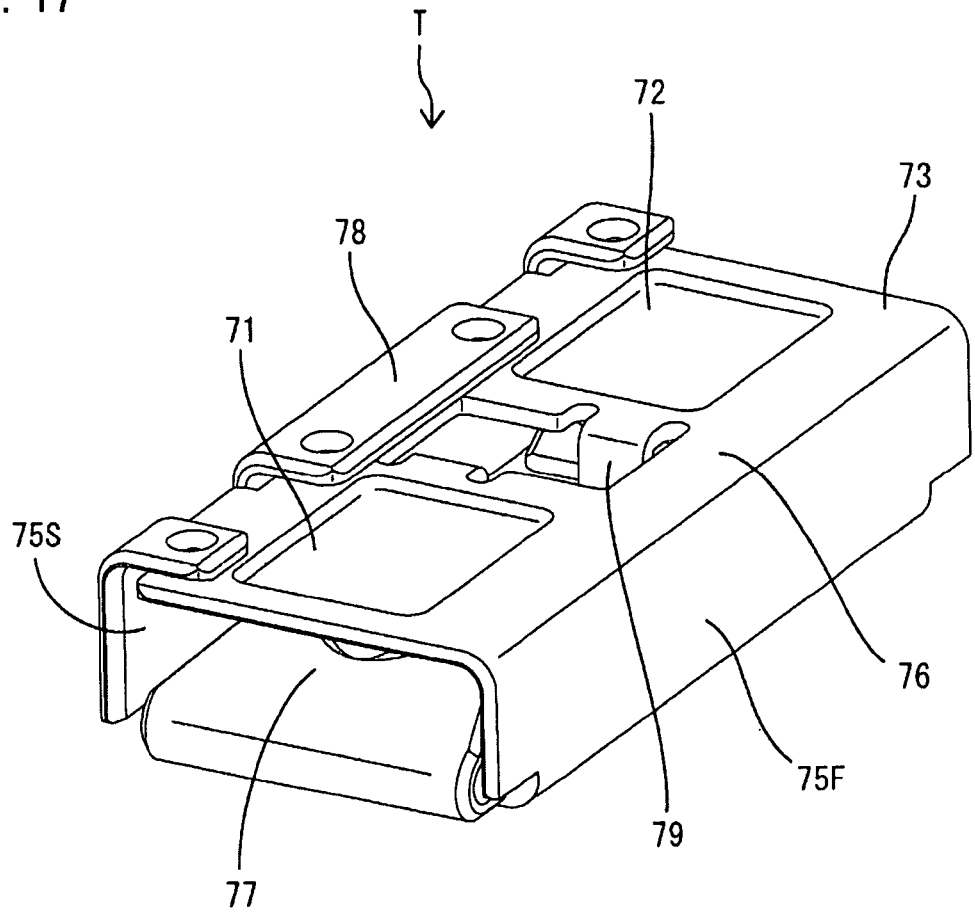
FIG. 17 is a perspective view showing a connection terminal.
Figure 18:
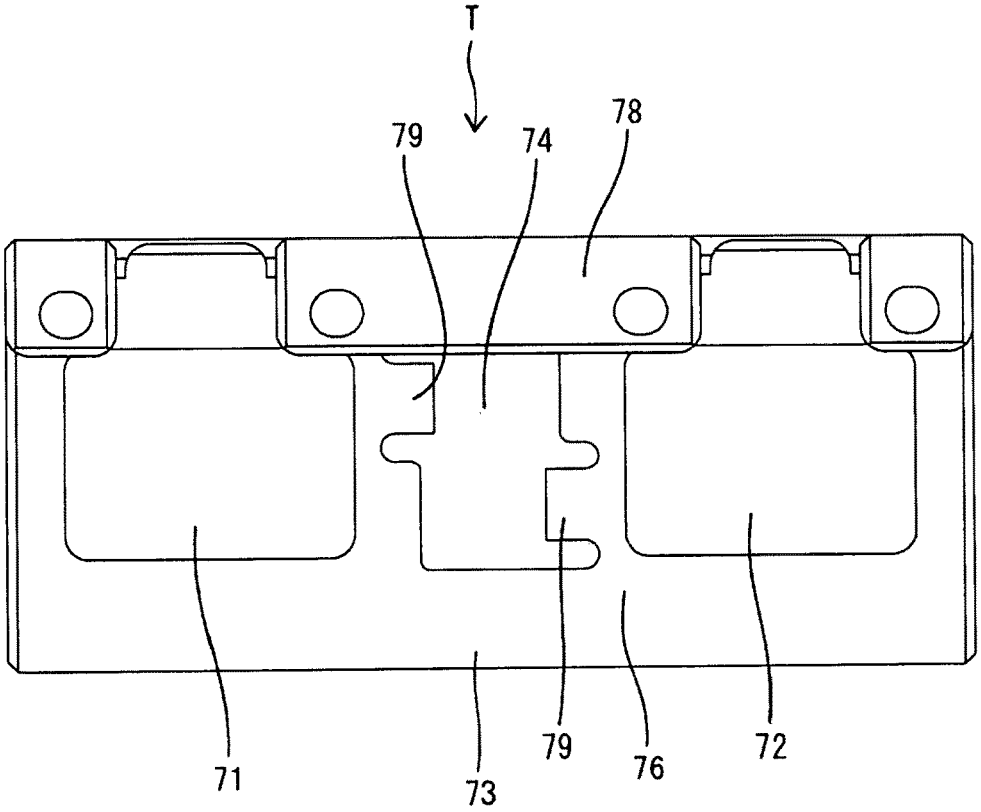
FIG. 18 is a plan view showing the connection terminal.
Figure 19:
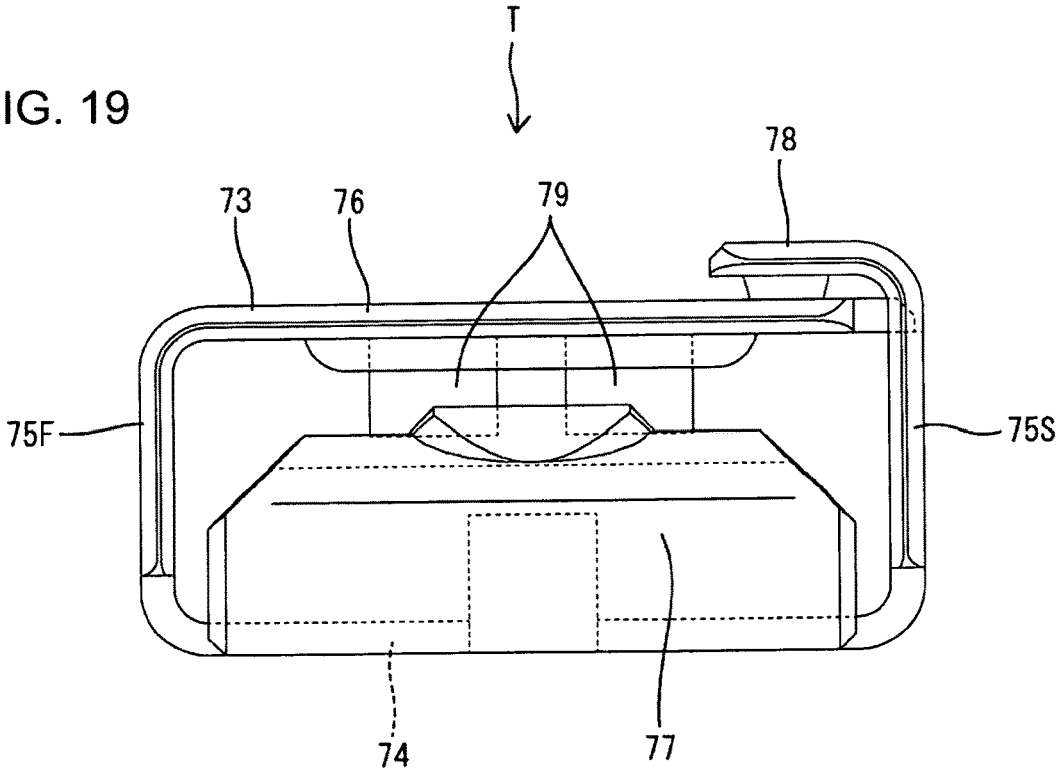
FIG. 19 is a front view showing the connection terminal.

As shown in FIG. 17, the connection terminal T includes a terminal body 73 in the form of a flat box-shaped tube and is open in a front-rear direction. The first and second connecting portions 71, 72 are provided on both front and rear end parts of the terminal body 73. The first and second connecting portions 71, 72 are configured similarly to the female terminal 30 of the first embodiment.

Similarly to the box 31 of the female terminal 30, the terminal body 73 includes a bottom wall 74, a first side wall 75F, a second side wall 75S and a ceiling 76, and resilient contacts 77 are provided inside. The resilient contacts 77 are provided in both the front and rear end parts of the terminal body 73 and are cantilevered in toward a center in the front-rear direction from the front and rear ends of the terminal body 73 (see FIG. 16). Note that a hook 78 of the first connecting portion 71 and a hook 78 of the second connecting portion 72 are connected in a central part of the terminal body 73.

Figure 16:
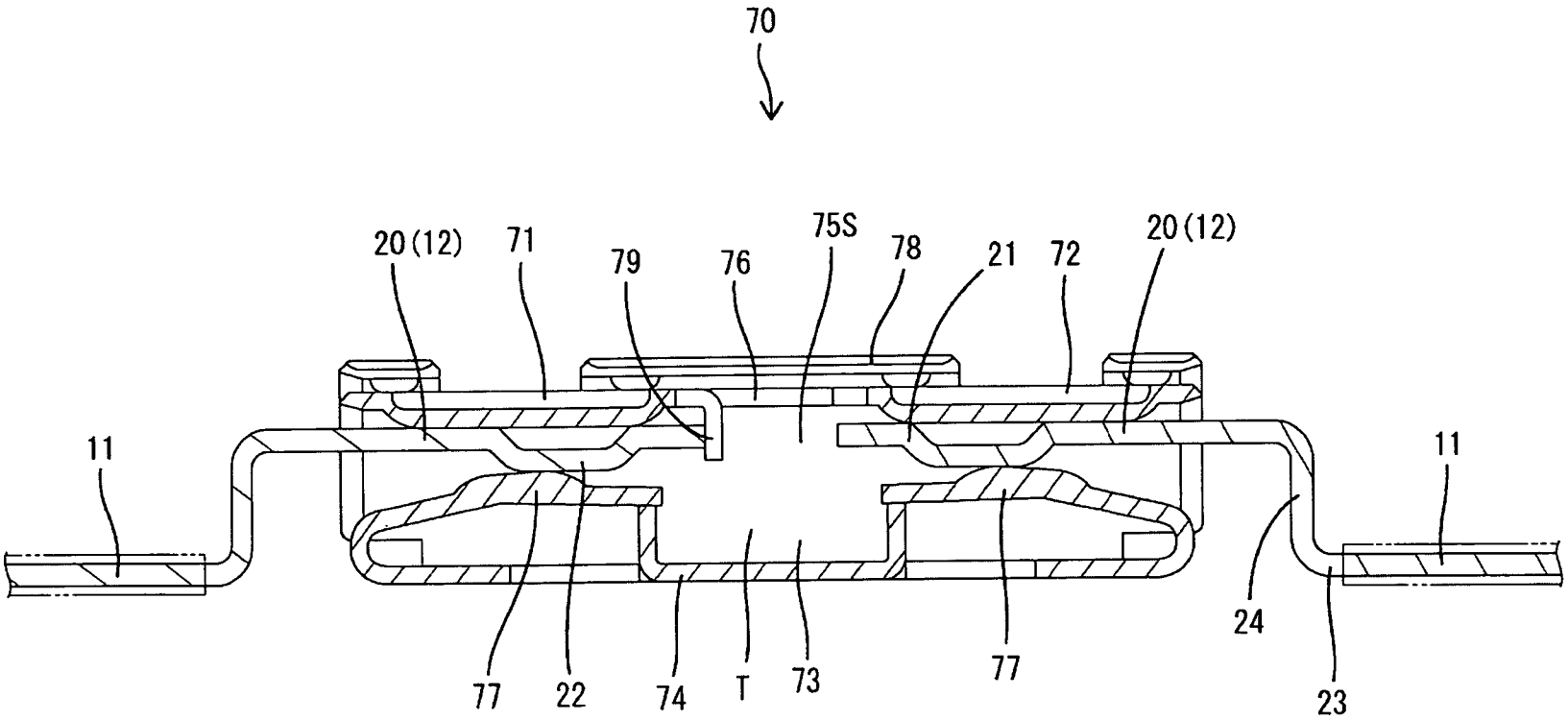
FIG. 16 is a section along B-B of FIG. 14 showing the plate-like conductive member connection structure in the state where the terminal portions are connected.

The terminal body 73 is provided with stoppers 79 for stopping the tips of the projecting pieces 21 of the male terminals 20 (see FIG. 16). The stoppers 79 are provided in a central part (between the first and second connecting portions 71, 72) of the terminal body 73 in the front-rear direction, and project in substantially at a right angle from the ceiling 76. Two of the stoppers 79 are provided while being slightly separated from each other toward the side of the first connecting portion 71 and the side of the second connecting portion 72. The stoppers 79 are disposed at positions displaced on one side and the other side in a width direction (see FIG. 18).

The plate-like conductive path 70 in this embodiment is connected by connecting the terminal 12 of the one plate-like conductive member 11 and the terminal 12 of the other plate-like conductive member 11 respectively to the connection terminal T. When the terminal portions 12 of the plate-like conductive members 11 are connected to the connection terminal T, the projecting pieces 21 of the male terminals 20 enter between the resilient contacts 77 and the ceiling 76 and are pressed against the ceiling 76 by resilient restoring forces of the resilient contacts 77 similarly to the connection of the terminals 12 of the first embodiment.

Figure 15:
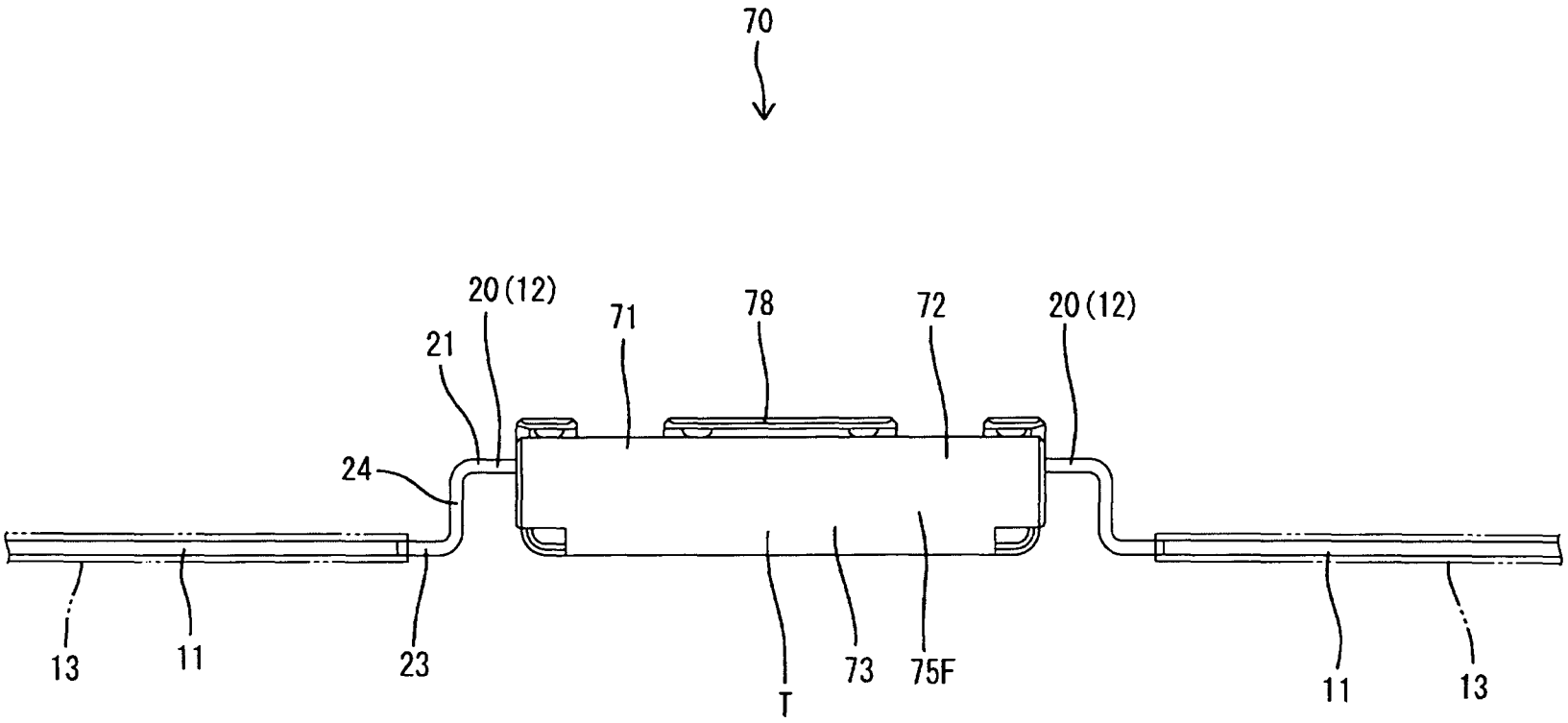
FIG. 15 is a side view showing the plate-like conductive member connection structure in the state where the terminal portions are connected.

Further, the tips of the projecting pieces 21 butt against the stoppers 79, thereby preventing any further insertion of the projecting pieces 21. In this way, the terminals 12 of the plate-like conductive members 11 are connected respectively to the first and second connecting portions 71, 72 of the connection terminal T. Height positions (positions in the plate thickness direction) of the plate-like conductive members 11 connected via the connection terminal T are aligned and the bottom portion 74 of the connection terminal T and the plate-like conductive members 11 are disposed at the same height position, as shown in FIG. 15.

As described above, in this embodiment, the plate-like conductive members 11 are connected to each other by the terminals 12 respectively provided on the plate-like conductive members 11 as in the first embodiment. Therefore, the plate-like conductive members 11 can be connected without using a connecting component such as a wire and the number of connecting components can be reduced. In addition, since the terminals 12 are connected via the connection terminal T, the terminals 12 can have the same shape.

Fourth Embodiment

Figure 20:
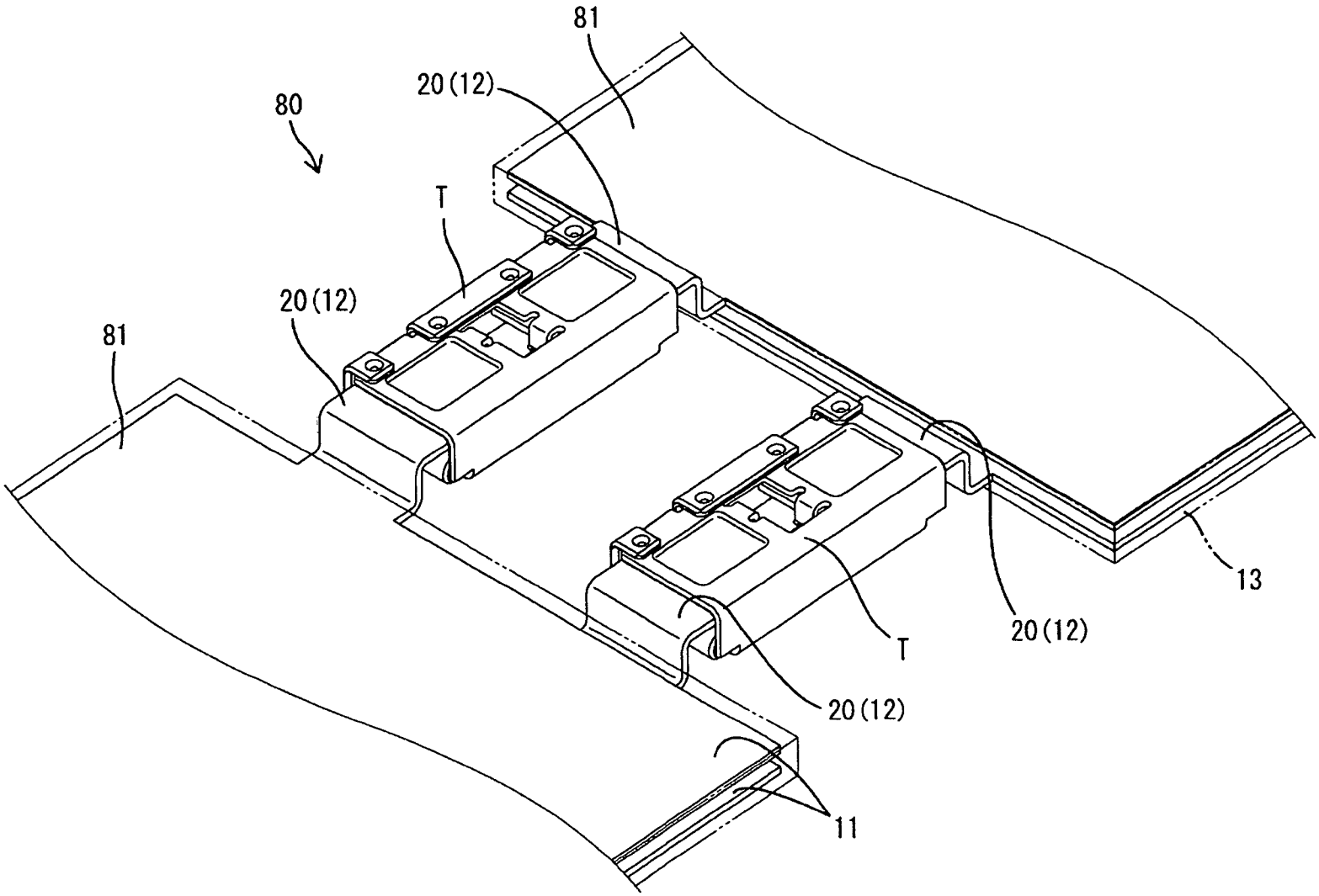
FIG. 20 is a perspective view showing a plate-like conductive member connection structure in a fourth embodiment in a state where terminal portions are connected.

Next, a plate-like conductive path 80 according to a fourth embodiment of the invention is described with reference to FIG. 20.

The plate-like conductive path 80 of this embodiment differs from the third embodiment in that a plurality of plate-like conductive members 11 are arranged at an interval in a plate thickness direction. Note that the same components as in the third embodiment are denoted by the same reference signs and repeated description is omitted.

The plate-like conductive path 80 according to this embodiment is such that the plate-like conductive members 11 are arranged at an interval in the plate thickness direction. The two plate-like conductive members 11 are overlapped while being insulated by an insulating member 13, and entirely covered and protected by the insulating member 13.

The plate-like conductive members 11 are made of a metal material such as aluminum or aluminum alloy as in the third embodiment. The plate-like conductive members 11 overlapped on top and back sides have equal width and length.

Conductive members 81 each including the two plate-like conductive members 11 overlapped on the top and back sides and the insulating member 13 are connected to each other via terminals 12 as in the third embodiment. The terminals 12 are displaced from each other in a width direction in the plate-like conductive members 11 provided in the conductive member 81. In this embodiment, the terminal 12 of one plate-like conductive member 11 is provided on one side in the width direction, and the terminal 12 of the other cm 11 is provided on the other side in the width direction.

Any of the terminals 12 is a male terminal portion 20 as in the third embodiment. Two of the male terminals 20 provided on one conductive member 81 have the same shape and are disposed at positions symmetrical with respect to the width direction. Height positions of projecting piece portions 21 of the male terminal 20 on the top side and the male terminal 20 on the back side are displaced by as much as a displacement between height positions of the plate-like conductive members 11.

Further, connection terminals T are configured similarly to that of the third embodiment.

The plate-like conductive path 80 in this embodiment is connected by connecting the terminals 12 of one conductive member 81 and the terminals 12 of the other conductive member 81 respectively to the connection terminals T. The terminals 12 of the plate-like conductive members 11 on the top sides of the conductive members 81 are connected to each other via the connection terminal T and the terminals 12 of the plate-like conductive members 11 on the back sides of the conductive members 81 are connected to each other via the connection terminal T. With the conductive members 81 connected, height positions (positions in the plate thickness direction) of the plate-like conductive members 11 on the top side are aligned and height positions of the plate-like conductive members 11 on the back side are aligned.

As described above, in this embodiment, the plate-like conductive members 11 are connected to each other by the terminal portions 12 respectively provided on the plate-like conductive members 11 as in the third embodiment, wherefore the plate-like conductive members 11 can be connected without using a connecting component such as a wire and the number of connecting components can be reduced. In addition, since the terminals 12 are connected via the connection terminals T, the terminals 12 can have the same shape.

The invention is not limited to the above described embodiments. For example, the following embodiments also are included in the scope of the invention.

Although the terminal 12 is integral to the plate-like conductive member 11 in the above embodiments, there is no limitation to this and a terminal may be formed separately and mounted on a plate-like conductive member by arbitrary fixing means.

Although the terminal 12 is exposed from the insulating member 13 in the above embodiments, there is no limitation to this and a terminal portion may be accommodated in a connector housing or the like.

Although the only one terminal 12 is provided on one plate-like conductive member in the above embodiments, there is no limitation to this and plural terminals may be provided on one plate-like conductive member and two or more plate-like conductive members may be connected to one plate-like conductive member.

Although the plate-like conductive member 11 is provided with the terminal 12 used for connection to the other plate-like conductive member 11 in the above embodiments, a terminal to be connected to a wire or the like may be additionally integrally provided to a plate-like conductive member.

Although the case of connecting the plate-like conductive members 11 having substantially the same shape is described in the above embodiments, there is no limitation to this and plate-like conductive members having different shapes (lengths and widths) may be connected.

Although the terminals 12 of one conductive member 61 are only the male terminal portions 20 and the terminal portions 12 of the other conductive member 61 are only the female terminal portions 30 in the above second embodiment, there is no limitation to this and male terminals and female terminals may be mixed on one conductive member.

Although the conductive member includes two plate-like conductive members 11 in the above second and fourth embodiments, there is no limitation to this and a conductive member may include three or more plate-like conductive members.

Although the connection terminal T is a relay terminal for relaying the pair of terminal portions 12 in the above third and fourth embodiments, there is no limitation to this and a connection terminal may be a joint terminal for joining three or more terminal portions.

LIST OF REFERENCE SIGNS

T . . . connection terminal
10, 60, 70, 80 . . . plate-like conductive path
11 . . . plate-like conductive member
12 . . . terminal
13 . . . insulating member
20 . . . male terminal
30 . . . female terminal
32 . . . resilient contact
50 . . . terminal constituting portion
61, 81 . . . conductive member

The invention claimed is:

1. A plate-like conductive member connection structure, comprising:

a first plate-like conductive member having conductivity and including a first side edge extending in a width direction, a male terminal formed unitarily with the first plate-like conductive member and projecting from the first side edge in a length direction normal to the width direction and parallel to a connecting direction and being at an intermediate position of the first side edge in the width direction;

a second plate-like conductive member having conductivity and including a second side edge extending in the width direction, a female terminal formed unitarily with the second plate-like conductive member and projecting from the second side edge in the length direction and being at an intermediate position along the second side edge in the width direction, the female terminal being formed integrally with a box portion open at opposite ends in the length direction and being configured to have the male terminal portion inserted therein, the box portion having opposed side walls and opposed bottom and ceiling walls extending between the side walls, the ceiling wall having a bulge portion bulging towards the bottom wall, a resilient contact piece provided in the box portion and configured to resiliently contact the male terminal, and an excessive deformation preventing portion provided to contact a free end of the resilient contact piece and prevent excessive deformation thereof; wherein the box portion is constituted by a terminal constituting portion stamped out in such a manner as to be confined within a range of the second edge in the width direction of the second plate-like conductive member in a developed state before machining, and the male terminal is inserted into the box and sandwiched between the bulge portion and the resilient contact piece.

2. The plate-like conductive member connection structure of claim 1, wherein:

each of the first and second plate-like conductive members is made of aluminum or aluminum alloy; and the resilient contact piece is made of copper, copper alloy or stainless steel.

3. A plate-like conductive member connection structure, comprising:

a first plate-like conductive member having conductivity and including a first side edge extending in a width direction, a first male terminal formed unitarily with the first plate-like conductive member and projecting from the first side edge in a length direction normal to the width direction and parallel to a connecting direction and being at an intermediate position of the first side edge in the width direction;

a second plate-like conductive member having conductivity and including a second side edge extending in the width direction, a second male terminal formed unitarily with the second plate-like conductive member and projecting from the second side edge in the length direction normal to the width direction and parallel to the connecting direction and being at an intermediate position of the second side edge in the width direction, the first and second plate-like conductive members being connected to each other by the first and second male terminals respectively provided on the first and second plate-like conductive members;

each of the first and second terminals includes a projecting piece bent in a stepped manner to be slightly displaced toward one side in a plate thickness direction of the respective plate-like conductive member;

a connection terminal in the form of a box open at opposite ends in a connecting direction, the connection terminal having opposed side walls and opposed bottom and ceiling walls extending between the side walls, first and second resilient contact pieces cantilevered respectively from the opposite ends of the connection terminal and having free ends disposed in a central region of the connection terminal, first and second excessive deformation prevention portions projecting from the bottom wall of the connection terminals at positions aligned with the free ends of the resilient contact pieces to prevent excessive deformation of the resilient contact pieces; wherein the first and second male terminals are sandwiched respectively between the first and second resilient contact pieces and the ceiling wall; and positions of the first and second plate-like conductive members connected via the connection terminal are aligned in the plate thickness direction and a bottom portion of the connection terminal and the first and second plate-like conductive members are disposed at the same height position.

4. A plate-like conductive path, comprising:

the first and second plate-like conductive members of claim 3; and insulating members configured to cover at least parts of the first and second plate-like conductive members.

5. The plate-like conductive path of claim 4, further comprising:

a third plate-like conductive member arranged at an interval from the first plate-like conductive member in a plate thickness direction; and one of the insulating members disposed to insulate between the first and third plate-like conductive members.

6. The plate-like conductive path of claim 5, further comprising:

a fourth plate-like conductive member arranged at an interval from the second plate-like conductive member in a plate thickness direction; and one of the insulating members disposed to insulate between the second and fourth plate-like conductive members.

* * * * *